United States Patent [19]

Siwek

[11] Patent Number: 5,071,033

[45] Date of Patent: Dec. 10, 1991

[54] TABLET DISPENSER

[75] Inventor: Thomas J. Siwek, Wheaton, Ill.

[73] Assignees: Practical Products, Co., West Chicago, Ill.; Market, U.S.A., Summerfield, N.C.

[21] Appl. No.: 558,608

[22] Filed: Jul. 26, 1990

[51] Int. Cl.[5] ..... B65H 1/08

[52] U.S. Cl. ..... 221/229; 221/247; 221/251; 221/270

[58] Field of Search ..... 221/228, 229, 227, 246, 221/247, 249, 251, 270, 276, 279

[56] References Cited

U.S. PATENT DOCUMENTS 2,255,450 9/1941 Mutchler ..... 221/229 X
3,410,455 11/1968 Haas ..... 221/229
3,565,284 2/1971 Hinterreiter ..... 221/229
4,589,575 5/1986 Rigberg et al. ..... 221/228 X

*Primary Examiner*—David H. Bollinger
*Attorney, Agent, or Firm*—Lee, Mann, Smith, McWilliams & Sweeney

[57] ABSTRACT

A dispenser for edible tablets having a cylindrical case and a spring biased plunger therein for urging a stack of tablets within the case upwardly. Detents formed around the open end of the case hold the tablets in the spring biased arrangement. A closure cap is pivotally mounted on the case and includes a lifting arm that extends into the case to fit underneath the top tablet in the stack to pivot it upwardly and outwardly while preventing movement of the next tablet out of the case until the cap is reclosed and the lifting arm repositioned relative to the next tablet.

15 Claims, 2 Drawing Sheets

TABLET DISPENSER

BACKGROUND OF THE INVENTION

The invention is directed toward a device for holding and dispensing tablets. More specifically, the invention is directed toward a pocket-size dispenser for mints, candies, and the like, having a disc-shaped form. More particularly, the invention is directed toward a cylindrical dispenser for dispensing a plurality of edible tablets store within a stacked column.

The invention serves the purpose of providing a handy portable container for storing edible tablets in a ready-to-be-dispensed orderly and neat fashion. Many types of breath mints, antacid tablets, candies, and other edible products, are sold in cylindrical packaging and have generally disc-shape. The invention is well suited to holding a package full of such edible tablets, for example, LIFESAVER brand candies, CERTS brand mints, TUMS brand antacid pills, and the like.

A problem solved by the invention is the way to store these types of tablets without requiring the peeling away of wrapping paper or removing individual pieces from the package as sold. The invention will store in a closed, preferably plastic, container the content of the package in a way that allows for a single tablet to be dispensed at a time, while retaining the others in a secure way.

The invention therefore also is a benefit to consumers by providing a closed container case, for the mints, candies, etc., which keeps them clean and sanitary.

SUMMARY OF THE INVENTION

The invention comprises, in preferred form, a cylindrical outer shell having an inner, lower annular seat for retaining the bottom loops of a coiled spring. On top of the spring a generally disc-shaped plunger is carried and serves as a seat for the tablets and which urges them upwardly. The top of the shell-like container includes hinge seats for a pivotal cap. The shell-like container further includes detents for preventing the tablets from being unintentionally pushed outwardly of the container and an outward protrusion for snap engagement with the cap. The cap is hingedly attached to the hinge seats of the container on pins generally at opposite sides of a lift arm formed therewith and capable of lifting upward the topmost tablet in the stack within the container while at the same time preventing the next tablet from moving outwardly. The cap may be pivoted closed while the detents hold the next tablet. The lift arm is then pivoted back to a position ready for engagement with the next tablet when the consumer is ready to dispense another candy, mint, or the like.

DETAILED DESCRIPTION OF THE INVENTION

Figure 1:
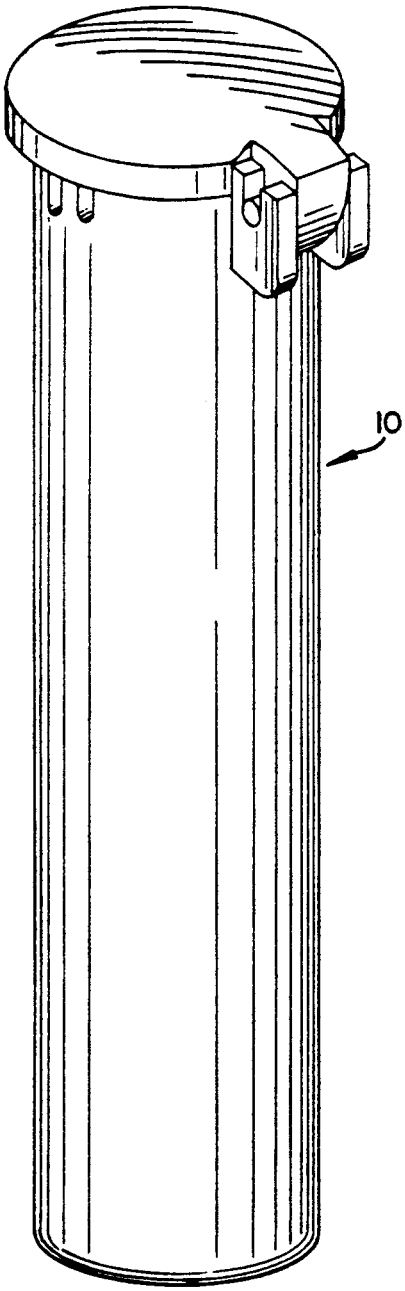
FIG. 1 is a perspective view of the tablet dispenser in accordance with the invention and showing the cap closed.

In FIG. 1, a tablet dispenser 10 in accordance with the invention is shown in a perspective view closed for holding tablets such as breath mints, antacid tablets, candies, or the like. Preferably, the invention embodied in tablet dispenser 10 is provided for dispensing disc-shaped tablets of a wellknown configuration often sold in tubular wrapped packages containing a cylindrical stack of the product items. Famous examples of which are TUMS, CERTS, ROLAIDS antacid tablets and LIFESAVERS candies. Prismatic shaped products are, however, not excluded from the scope of the invention.

Figure 2:
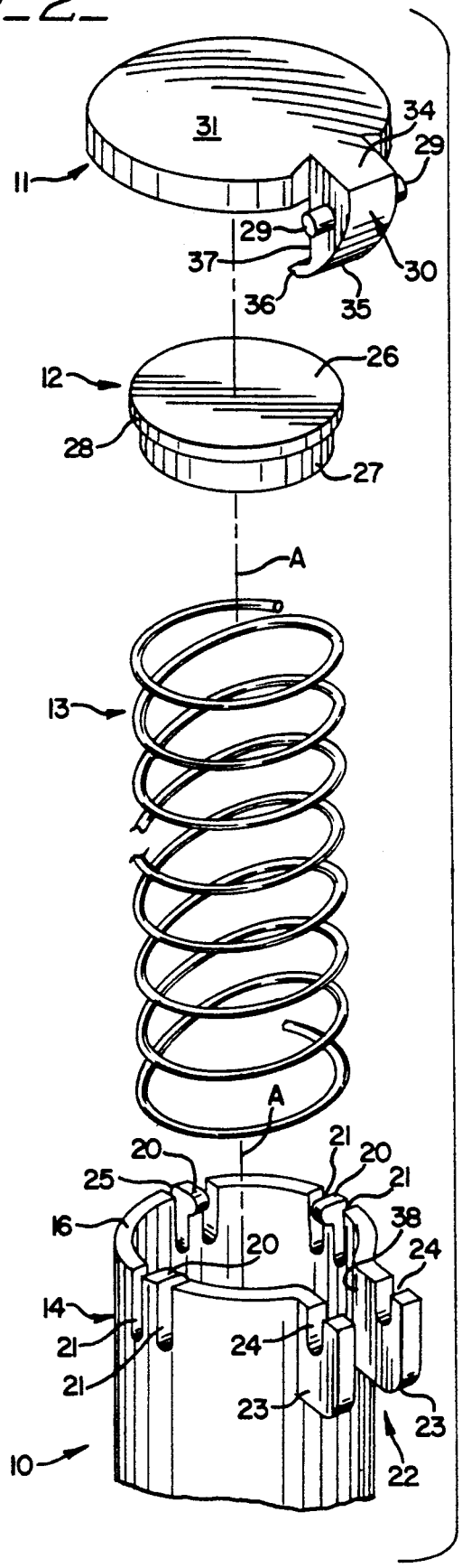
FIG. 2 is an exploded view of the table dispenser as in FIG. 1 and showing a cap, plunger, coil spring and a top portion of the shell-like case.

The tablet dispenser 10 will be more fully understood in connection with the exploded view shown in FIG. 2. The tablet dispenser 10 comprises in the descending arrangement of elements shown: a cap 11, a plunger 12, a helical coil spring 13, and a shell-like case 14. Before explaining the specific details of the constructions for these four components, it should be understood that the tablet dispenser 10 is provided to maintain a stack of tablets atop the plunger 12 which is spring biased upwardly by the coil spring 13 against the cap 11, which cap acts as both a holder and dispenser means for the stack of tablets within the case 14. The cap 11 is hingedly arranged on the case 14 and is constructed whereby to lift upwardly, along one place on the periphery of a tablet, tablets one at a time, while retaining therebelow the next tablet in order and preventing it from unintentionally being fed upwardly out of the case 14.

Figure 3:
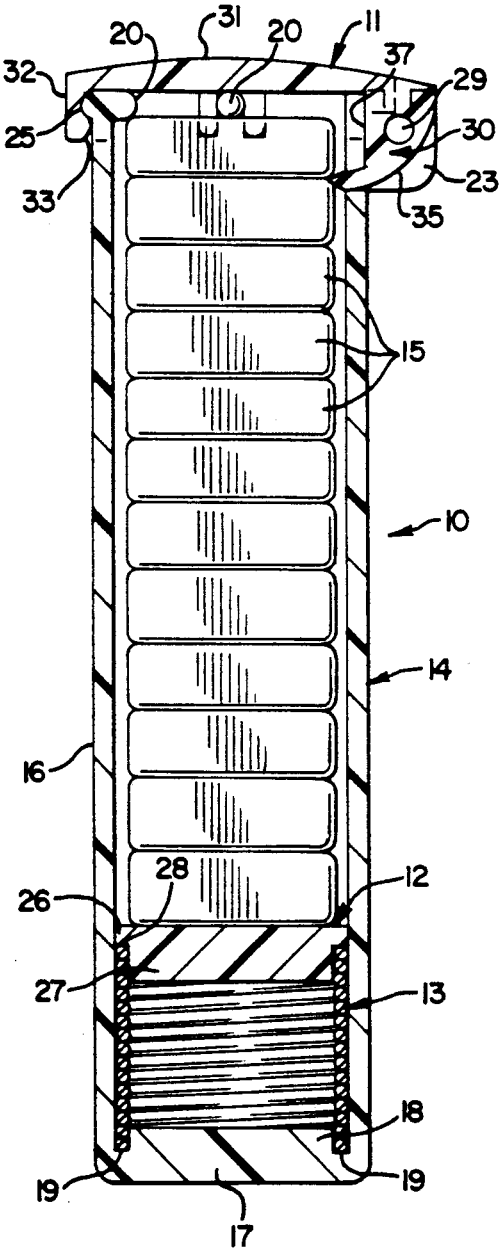
FIG. 3 is a vertical sectional view of the tablet dispenser with the cap closed.
Figure 4:
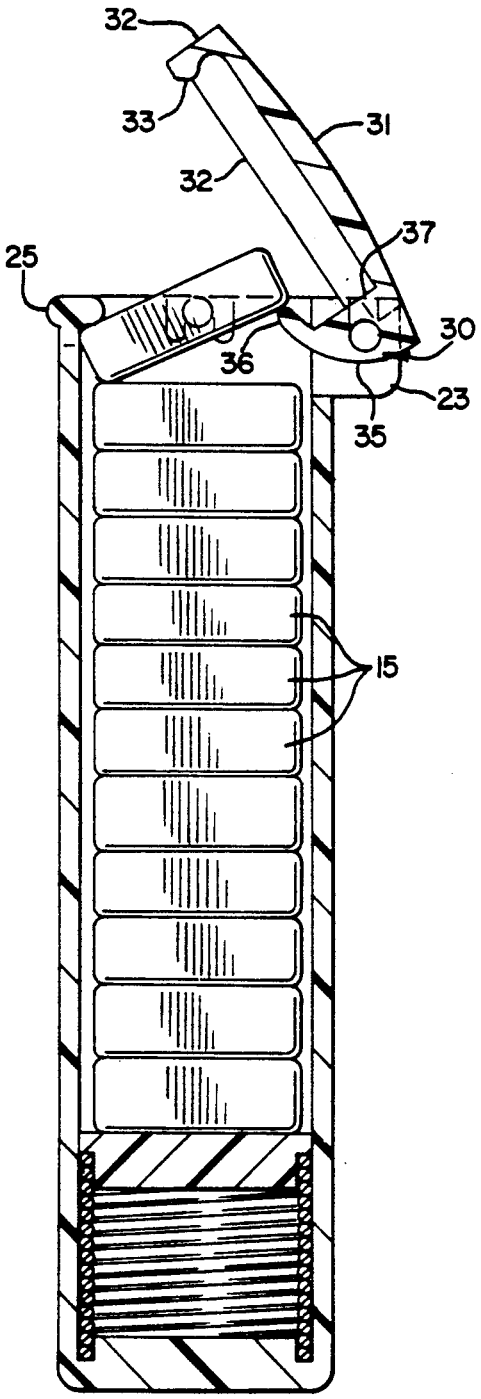
FIG. 4 is a central vertical section of the tablet dispenser showing the cap opening and dispensing the top tablet.

The particular details of the components of the tablet dispenser 10 will be further best understood in connection with the vertical sectional views of FIGS. 3 and 4 which show the tablet dispenser 10 in the closed and open dispensing arrangements, respectively. There it will be seen that a stack of tablets 15 are retained within the case 14 atop the plunger 12, which by action of the resilient coiling of the spring 13, biases the stack of tablets 15 upwardly toward the cap 11.

The main body of the tablet dispenser 10 is the case 14 which provides engageable means for the cap 11, the plunger 12 and the spring 13. The cap 11, the plunger 12 and the spring 13 will be seen to thereby comprise functional operating devices for functional movement relative to the case 14. The case 14 is shell-like in construction with a circular vertical wall 16 and an integral bottom wall 17 that includes a raised pad 18 having a diameter less than that of the shell-like wall 16 thereby defining an annular seat 19 sized whereby to receive lower loops of the spring 13. The spring 13 may be a standard steel wire coil-type, or equivalent, as would be appreciated by those skilled in the art. It is important to maintain the spring in vertical alignment and therefore it is desirable that the annular seat 19 have a depth sufficient to accommodate two or more loops of the coiled spring 13, i.e. have a depth at least equal to two times the diameter of the wire forming the spring 13. At the other, or top, end of the shell-like wall 16, the case 14 is open and includes therearound, in the exemplary embodiment, three detents 20, each formed between two cut-out notches 21, thereby allowing the detents 20 to be resiliently movable inwardly and outwardly of the case 14 for the passage of tablets into and out of the case 14. The detents 20 are important for preventing tablets from unintentionally falling out of the case 14. In the preferred embodiment the inward protrusion of the detents 20 is 0.050 inches inwardly of the inner diameter of the shell-like wall 16, which is 0.760 inches in the disclosed embodiment. Also, in the exemplary embodiment, two of the detents 20 are diametrically opposed and the other is located halfway therebetween along the periphery of the case 14 and diametrically opposed to a hinge 22. The hinge 22 is comprised of a pair of extensions 23 having upwardly open hinge seats 24 providing means for hingedly engaging the cap as will be explained below. The hinge seats 24 are spaced from the case 14 to provide pivot points for the cap 11 and must be correspondingly arranged so that the cap 11 can effectively lift a tablet out of the case 14 but still be movable to allow a fresh stack of tablets to be inserted.

The case 14 includes an outward protuberance 25 formed at the outside of the detent 20 that diametrically opposes the hinge 22, as best seen in FIG. 3. This protuberance 25 provides for a detent snap-engagement with the outside of the case 14 allowing the cap 11 to be snapped closed and held in the closed position for maintaining tablets 15 therein when the dispenser 10 is not in use. It is envisioned that the case 11 be made of a semi-rigid plastic resin which allows for a resilient snap-action engagement of the protuberance 12, as well as the flexibility of the detents 20, and snap-engagement to the hinge seats 24 by the cap 11.

The plunger 12 is generally plug-shaped and includes an upper circular portion 26 and a lower integral portion 27 having a smaller diameter. The configuration provides an annular shoulder 28 therebetween for placement therearound of the upper loops of the spring 13. For maintaining proper alignment, and support, for the tablets 15, the diameter of the upper portion 26 is equal to or slightly less than the inner diameter of the shell-like wall 16 whereby to be axially slidable therein. The shoulder 28 is formed whereby to have a width of equal to or slightly greater than the thickness of the wire forming the coiled spring whereby to snugly sit atop the coiled spring and receive a very controlled even pressure from the spring to be transferred to the stack of tablets 15 in order to smoothly bias the tablets toward the open end of the case 14. The height of the lower portion 27 is in preferred form equal to at least two times the diameter of the wire forming the spring 13, so that at least two loops of the spring 13 extend around the lower portion 27 to assure this desired stability and even upward pressure against the stack of tablets 15. Similarly, it is envisioned that the plunger 12 be formed of a semi-rigid plastic resin.

The dispensing operation of the tablet dispenser 10 is accomplished by the combined actions of the cap 11 and the case 14. The cap 11 serves two primary functions. Firstly, it operates to lift the edible tablet products up and outwardly of the case 14. This is accomplished in a pivoting motion. Second, it provides a snug closure over the case 14.

The cap includes a pairs of pivot pins 29 that extend in opposite directions from a lift arm 30 integrally formed with a covering dome-like lid 31 of the cap 11. The pivot pins are snap-engageable at the hinge seats 24 of the case 14 for purposes of rotating the cap 11 therearound.

The covering lid 31 of the cap is further integrally formed with a circular peripheral depending wall 32 which extends downwardly around the case 14 to form a closure therewith, generally diametrically opposed to the lift arms 30 the depending wall 32 includes an inward protuberance 33 located whereby to snap-over the outward protuberance 25 of the case 14 to be snapped shut on the top of the case 14 in the snugly closed position.

The structure of the lift arm 30 is critical to the operation of the invention so that it may operate to dispense tablets one at a time while preventing the next tablet in the stack from inadvertently being dispensed, or falling out of the case 14. The lift arm 30 integrally extends from the lid portion 31 in a first generally flat section 34 that projects to meet an arcuate portion 35 that curves downwardly to terminate at a radiused inward extending tip 36. In the disclosed mode of the invention the radius of the tip 36 is small, about 0.015 inches, which facilitates prying insertion between tablets. The tip 36 recurves to extend to a generally flat inner flat wall 37 that extends generally parallel to the long axis A of the cylindrical case 14, when the cap is closed, as best seen in FIGS. 2 and 3. The tip 36 is formed whereby to extend generally at right angles to the wall 37 and therefore is substantially transverse to the long axis A of the cylindrical casing 14 and thereby parallel to the bottoms of the disc-shaped tablets 15 and at a height within the case 14 to poke between the first and second tablets in a stack for lifting along the circular bottom edge of the first tablet to dispense it, as shown in FIG. 4. Accordingly, the lengthwise location of the tip 36 within the case 14 is critical and depends upon the thickness of the tablets intended to be dispensed.

It will be seen that the lift arm 30 moves inwardly and outwardly of a cut-out notch 38 formed between the extensions 23 of the case 14 to permit movement of the tip 36 inwardly and outwardly of the shell-like wall 16.

With further reference to FIG. 3, when the cap 11 is in the closed position the uppermost tablet 15 is held around its upper edge by the detents 20. The location of the tip 36 is therefore required to be below the elevation of the detent 20 at a spacing of about equal to, or slightly more than the tablet thickness, whereby to generally reside co-planar with the plane of interface contact between the topmost and second tablet in the stack of tablets 15. Usually, tablets of this design such as CERTS brand, TUMS brand, ROLAID brand and candy rings sold under LIFESAVERS brand, and the like, do not have sharp corner surfaces, probably in part so that they do not chip or fracture. The tablet edges are rounded, or bevelled, whereby insertion therebetween of the tip 36 of the lift arm 30 is aided allowing the top tablet to be easily pried from the second tablet and pivoted upwardly, as shown in FIG. 4. When cap 11 is closed, the tip 36 resides generally in a zone between the inner surface of the wall 16 and the stack of tablets 15 in the extended plane of the interface between the first and second tablets.

When a tablet is to be dispensed, the consumer urges upwardly the protuberance 30 over the protuberance 25. At the same time the cap 11 pivots on pivot pins 29 forcing the tip 36 to pry between the first and second tablets in the stack of tablets 15. The arcuate rear surface 35 rotates therewith inwardly of the case 14 and blocks the next tablet to prevent it from being unintentionally dispensed. As the topmost tablet is expelled from the case 14, the next tablet will move upwardly into contact with the detents 20 and the blocking arcuate surface 25. When the top tablet is fully dispensed the cap is rotated back to snap-engage the protuberance 33 over protuberance 25. The arcuate surface 35 will have rotated across the top edge of the blocked next tablet until the cap 11 is fully closed to again reposition the tip 36, co-planar with the interface of the next two sequential tablets, as shown in FIG. 3. When the last tablet is taken from the tablet dispenser 10, it may be reloaded with a fresh supply of mints or candies by opening the cap and rotating it approximately 90° to be generally parallel to the longitudinal axis A. At that rotation, the arcuate surface 35 resides in a position that does not impede the entrance of new tablets into the case 14 and preferably spaced relative to the wall 16 to be no further inward than the inward extension of the detents 20 from shell-like wall 16.

The resilient structure of the detents 20 allows the tablets 15 to be pushed downwardly and flex the detents outwardly whereupon after a tablet has been loaded, the detents 20 resiliently move back to the arrangement as shown in FIG. 3 to hold the top most tablet pressing against the detents. In preferred form, the inner diameter of the shell-like wall 16 is larger than the diameters of the tablets to be dispensed to create a spacing therebetween. In that way only end portions of the detents 20 contact the edges of the tablets 15, as best seen in FIG. 3 at the leftmost detent 20. This spacing provides room for the tablets to slide under the detents to make it easier for lift arm 30 to tilt-up a tablet, as shown in FIG. 4, than if the tablets were the same diameter as the wall 16.

While the invention has been described in connection with an illustrative embodiment, it is not limited thereto. It is considered that a wide range of equivalents fall within the claims appended hereto.

What is claimed is:

1. A hand-operated dispenser for dispensing edible tablets from a stack one at a time, said dispenser comprising:

a shell-like case with a closed bottom forming an annular seat, an upper open end having circumferentially therearound a plurality of inward extending resilient detents, engageable hinge seat means extending outwardly of the case adjacent an opening through the case along said upper end thereof and wherein one said resilient detent resides generally opposite said engageable hinge seat means;

coil spring means having a lower portion thereof residing within said annular seat;

plunger means atop said coil spring means for providing resilient biasing of a stack of tablets to be placed thereon within said case to be urged upward against said resilient detents; and a pivotal cap means having a lid integrally formed with a lifting arm means, said lifting arm means pivotally engaged at said hinge seat means of the case, said lift arm means including an outwardly arcuate portion terminating in an inward tip means said lifting arm means being movable through said opening of the case adjacent said hinge means, said tip means being movable from a position generally transverse to a long axis of the shell-like case to pry between a topmost and a second stacked tablet for lifting and tilting up a topmost table from a stack within said case and said arcuate portion movable to block a second tablet in a stack from being expelled from the case.

2. The dispenser as claimed in claim 1 wherein said plunger means includes indented shoulder means for engagement with said coil spring means.

3. The dispenser as claimed in claim 1 wherein the tip means of the lifting arm is spaced downwardly within the case at a distance below the resilient detents.

4. The dispenser as claimed in claim 3 wherein said distance between the resilient detents and said tip means is substantially the same as the thickness a tablet size to be dispensed.

5. The dispenser as claimed in claim 1 wherein said case and said cap means include snap-engageable closure means for securing the cap means closed over the case.

6. The dispenser as claimed in claim 1 wherein the case and cap means are each integrally formed from a semi-rigid plastic resin.

7. A dispenser for disc-shaped edible tablets comprising a case having a cylindrical shell-like wall having an open top and integrally formed with a closed bottom having a raise pad, the raised pad having a diameter less than the inner diameter of the cylindrical wall and forming therewith an annular seat;

a coiled spring having at least two loops thereof arranged within said annular seat and having a diameter substantially the same as the inner diameter of the shell-like wall of the case;

a plunger having shoulder means and resting atop said coiled spring, the plunger having a height sufficient to accommodate a plurality of loops of the coil under said shoulder and around said plunger, the plunger adapted to hold a stack of tablets thereon;

a dispensing closure cap having a lift arm pivotally arranged on said case for pivotal movement inward and outward of the case to pry between a topmost and a second tablet in a stack whereby to lift and tilt up tablets one at a time from a stack on the plunger; and, said case further including a plurality of resilient detent means extending inwardly of said open top for detaining a stack of tablets in spring biased arrangement on said plunger when said cap is at a closure position, one said resilient detent means disposed generally opposite the lift arm.

8. The dispenser as claimed in claim 7 wherein said lift arm includes an arcuate portion for blocking the movement of a second tablet in the stack while a first tablet is being dispensed.

9. The combination of a stack of edible tablets and dispenser therefor comprising:

a stack of substantially identical tablets stacked one on top of the other and each having a thickness and a diameter;

a dispenser storing the tablets for dispensing them one at a time and comprising a case storing said stack of tablets therein, the case having an open top, an inner diameter larger than the diameter of said tablets, and including engageable means at the bottom thereof, said case further having resilient detent means spaced therearound and contacting the top tablet in the stack and being resiliently movable inwardly and outwardly of the case;

a coiled spring means engaged at said engageable means of the case;

a plunger spring-biased atop said coiled spring means and supporting thereabove said stack of tablets to be spring biased in a direction toward the open top of the case; and, a pivotable closure cap snap-engageable to the case at the open top of said case and having an integrally formed lift arm means pivotal with the closure cap to move inwardly from a first position and upwardly to a second position below the top tablet in the stack to lift it upward and outward o the case, said lift arm means including an arcuate portion for blocking the upward movement of a next tablet in the stack until the lift arm means is pivoted to the first position.

10. The combination as claimed in claim 9 wherein said closure cap and case include snap engageable locking means.

11. The combination as claimed in claim 9 wherein the resilient detent means extend inwardly of the case a distance slightly larger than the difference between the inner diameter of the case and the diameter of said tablets.

12. The combination as claimed in claim 9 wherein at the said first position of the lift arm means the cap is in a closed position, said lift arm means includes a lifting tip residing generally coplanar with a plane of interface between the first and second tablets in the stack.

13. The combination as claimed in claim 9 wherein the pivotal closure cap includes a lid for covering the open top of the case, the lid being integrally formed with the lift arm means.

14. The combination as claimed in claim 9 wherein the coiled spring means is made of coiled wire and the spring engageable means of the case comprises an annular seat of a depth equal to at least two times the diameter of the wire whereby at least two loops of the coiled spring means reside within the seat.

15. The combination as claimed in claim 9 wherein the stack of tablets is in a package means.

* * * * *